US006364382B1

(12) United States Patent
Huang et al.

(10) Patent No.: US 6,364,382 B1
(45) Date of Patent: Apr. 2, 2002

(54) DRAWING PLATE STRUCTURE OF A LATCH OF AN AUXILIARY LOCK

(75) Inventors: Mu-Lan Huang; Chao-Ming Huang, both of Kaohsiung Hsien (TW)

(73) Assignee: Taiwan Fu Hsing Indusrial Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 09/933,077

(22) Filed: Aug. 21, 2001

(51) Int. Cl.[7] ..... E05B 3/08; E05B 3/10

(52) U.S. Cl. ..... 292/336.5; 292/1.5; 292/137; 292/165; 292/169; 292/169.18; 292/337; 292/DIG. 60; 70/134; 70/461; 70/449; 70/DIG. 60

(58) Field of Search ..... 292/336.5, 1.5, 292/337, 169, DIG. 60, 165, 169.8, 137; 70/134, 461, DIG. 60

(56) References Cited

U.S. PATENT DOCUMENTS 4,687,239 A * 8/1987 Lin ..... 292/172
4,876,866 A * 10/1989 Fleming et al. ..... 70/379 R
4,890,871 A 1/1990 Lin ..... 292/337
5,029,913 A * 7/1991 Wartian ..... 292/169 R
5,074,605 A 12/1991 Fann ..... 292/337
5,176,416 A * 1/1993 Lin ..... 292/143
5,364,138 A * 11/1994 Dietrich et al. ..... 292/1.5
5,562,314 A * 10/1996 Wheatland et al. ..... 292/1.5
6,030,008 A * 2/2000 Chang ..... 292/1.5
6,164,099 A * 12/2000 Sh ..... 70/134
6,318,769 B1 * 11/2001 Kang ..... 292/1.5

FOREIGN PATENT DOCUMENTS

TW 79204628 8/1990

* cited by examiner

*Primary Examiner*—Teri Pham Luu
*Assistant Examiner*—Carlos Lugo
(74) *Attorney, Agent, or Firm*—Bacon & Thomas, PLLC

(57) ABSTRACT

A drawing plate structure of a latch of an auxiliary lock includes a drawing plate having a top portion extended toward one side, thereby forming a top flat portion. A lock tongue is provided with a slot, and the top flat portion of the drawing plate is inserted into the slot of the lock tongue.

2 Claims, 2 Drawing Sheets

DRAWING PLATE STRUCTURE OF A LATCH OF AN AUXILIARY LOCK

BACKGROUND OF THE INVENTION

1. Field of the Invention

The present invention relates to a drawing plate structure of a latch of an auxiliary lock, wherein the drawing plate has a greater strength so as to support and withstand a larger impact force, so that the drawing plate may be used during a long-term utilization.

2. Description of the Related Art

The closest prior art of which the applicant is aware is disclosed in the applicant's Taiwanese Patent Publication No. 139733, entitled "Improved Structure of a Latch of a Auxiliary Lock". In such an improved structure, the lock tongue of the housing is directly combined with one end of a drawing plate. The other end of the drawing plate is provided with two drive teeth and a positioning tooth, so that the arm of the rotatable drive seat may be inserted between the two drive teeth, to press the drawing plate and the lock tongue to act.

However, the drawing plate is easily distorted and deformed during long-term utilization. In addition, when the lock tongue is subjected to a large breaking impact force, the combination position of the lock tongue and the drawing plate is easily broken.

SUMMARY OF THE INVENTION

The primary objective of the present invention is to provide a drawing plate structure of a latch of an auxiliary lock, wherein the drawing plate has a greater strength so as to support and withstand a larger impact force, so that the drawing plate may be used during a long-term utilization.

In accordance with the present invention, there is provided a drawing plate structure of a latch of an auxiliary lock including a drawing plate having a top portion extended toward one side, thereby forming a top flat portion. A lock tongue is provided with a slot, and the top flat portion of the drawing plate is inserted into the slot of the lock tongue.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
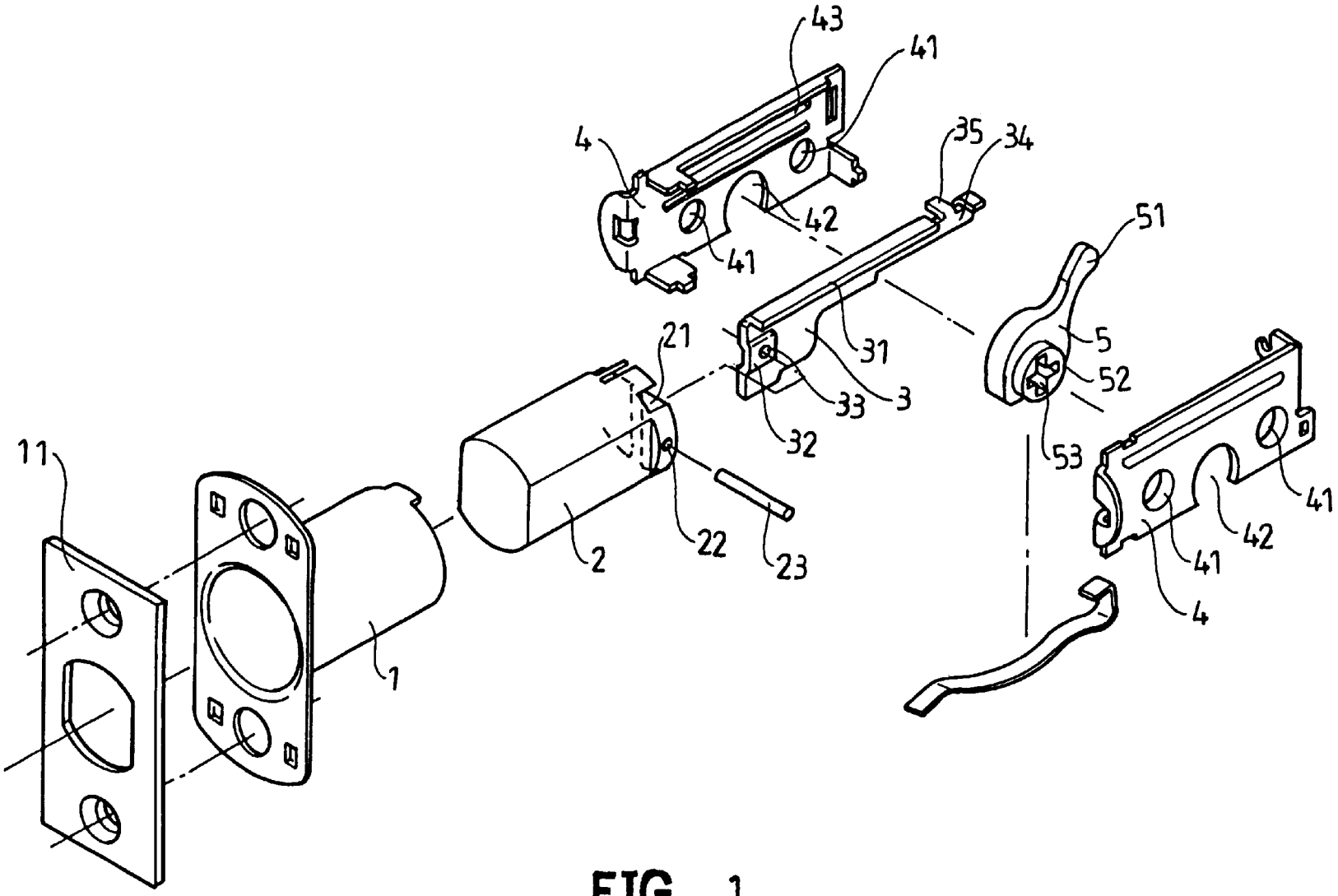
FIG. 1 is an exploded perspective view of a drawing plate structure of a latch of an auxiliary lock in accordance with the preferred embodiment of the present invention.

Referring to the drawings and initially to FIG. 1, the latch of an auxiliary lock in accordance with the preferred embodiment of the present invention comprises a housing 1, a lock tongue 2, a drawing plate 3, an assembly plate 4, and a drive seat 5.

The housing 1 may be a conventional structure. One end of the housing 1 may be combined with a rectangular face plate 11. The housing 1 itself may also be combined with a circular ring cover, so that the housing 1 may be fixed on the door plate at a proper position thereof. The other end of the housing 1 may receive the lock tongue 2 therein, and has a end edge which is combined with the assembly plate 4.

The lock tongue 2 may be received in the housing 1. A first end of the lock tongue 2 is combined with and driven by the drawing plate 3, so that the second end of the lock tongue 2 may extend outward from or retract into the face plate 11. The first end of the lock tongue 2 that is combined with the drawing plate 3 is provided with a slot 21 which includes a straight slot and a transverse slot. A positioning hole 22 is defined through the first end of the lock tongue 2 that is combined with the drawing plate 3. A positioning member 23 such as a pin or the like may be inserted into the positioning hole 22, for combining the drawing plate 3.

The drawing plate 3 is made of a metallic material, and may be punched by a metallic plate, thereby facilitating working the drawing plate 3. The top portion of the drawing plate 3 is bent and extended toward one side, thereby forming a top flat portion 31. The drawing plate 3 has a first end formed with a bent non-flat face 32 which is provided with a positioning hole 33 for passage of the positioning member 23, such that the drawing plate 3 may be combined with the lock tongue 2. The first end of the drawing plate 3 is inserted into the slot 21 of the lock tongue 2, and the second end of the drawing plate 3 is provided with an opening 34 into which the arm 51 of the drive seat 5 extends, so that the drawing plate 3 may be drawn and driven to move. The second end of the drawing plate 3 is provided with a guide block 35 which is protruded outward transversely. The guide block 35 may be moved along the straight groove 43 of the assembly plate 4.

The assembly plate 4 includes two plates which are combined with each other. Each of the two assembly plates 4 has one end fixed to the bottom end face of the housing 1. Each of the two assembly plates 4 is provided with two positioning holes 41 for passage of positioning posts of the lock, and a shaft hole 42 for positioning the drive seat 5 so that the drive seat 5 may be rotated in the shaft hole 42. At least one assembly plate 4 is provided with a straight groove 43 for limiting and guiding the guide block 35 of the drawing plate 3, so that the drawing plate 3 may be moved linearly.

The drive seat 5 has two side each provided with a circular portion 52 received in the shaft 42 of the assembly plate 4 to rotate therein. The drive seat 5 itself has a non-circular hole 53 for passage of the drive shaft of the lock, so that the drive seat 5 may be driven to rotate. The drive seat 5 has an arm 51 extended into the opening 34 of the drawing plate 3, for driving the drawing plate 3 and the lock tongue 2 to move.

Figure 2:
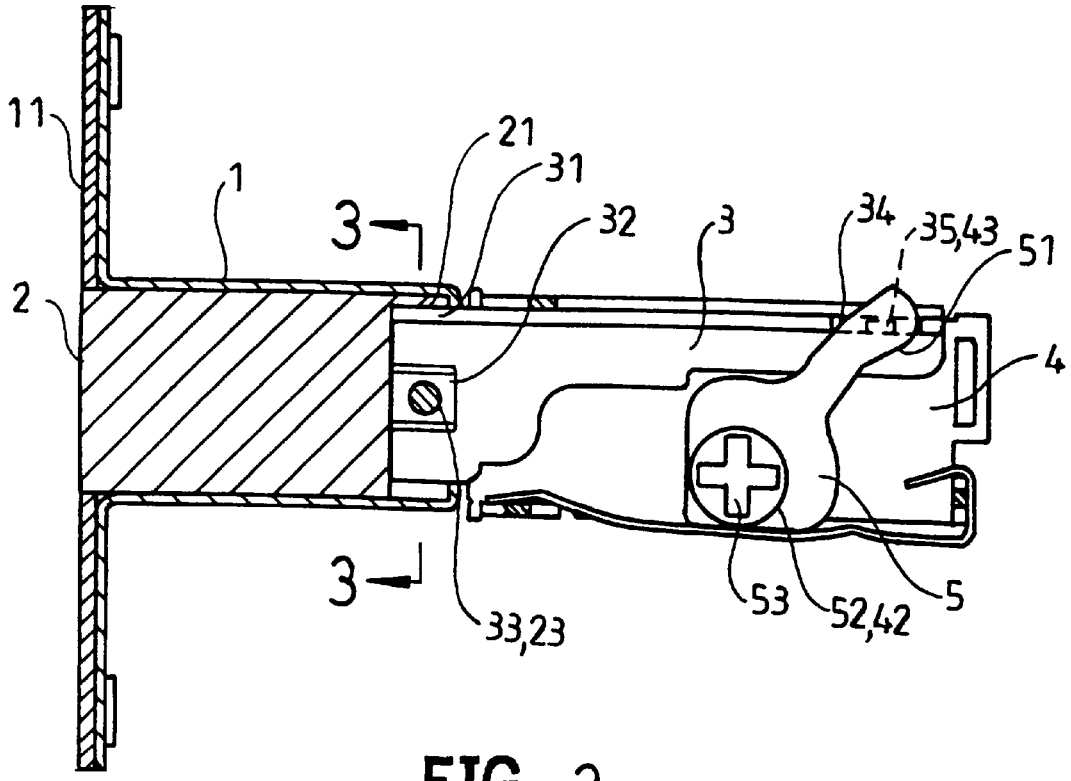
FIG. 2 is a front plan cross-sectional assembly view of the drawing plate structure of a latch of an auxiliary lock as shown in FIG. 1.
Figure 3:
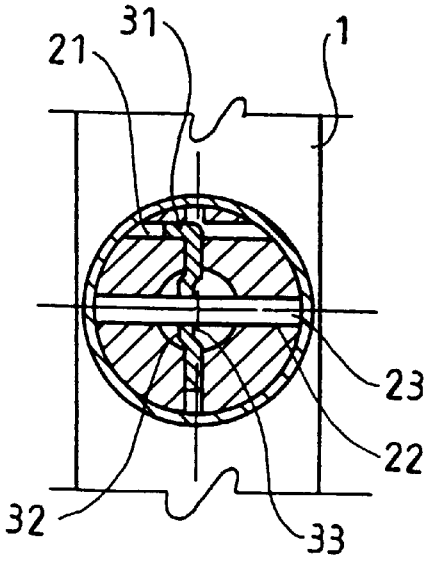
FIG. 3 is a cross-sectional view of the drawing plate structure of a latch of an auxiliary lock taken along line 3—3 as shown in FIG. 2.

Referring now to FIGS. 2 and 3, the assembly situation of the present invention is shown, the first end of the drawing plate 3 is locked into the slot 21 of the lock tongue 2, and the positioning member 23 is inserted into the positioning holes 22 and 33. The top flat portion 31 of the drawing plate 3 is locked in the slot 21 of the lock tongue 2, and the bent non-flat face 32 of the drawing plate 3 is locked in the slot 21 of the lock tongue 2. Thus, when the lock tongue 2 of the latch is subjected to an external breaking or impact force, the combination portion may have a larger strength to support and withstand the breaking force. In addition, the drawing plate 3 may also be used during a long-term utilization by provision of the top flat portion 31, without incurring the problem of bending or deformation.

Accordingly, in accordance with the structure of the present invention, the drawing plate is not bent easily. In addition, the combination position of the drawing plate and the lock tongue may also have a better strength, so as to support and withstand a larger external breaking force.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A drawing plate structure of a latch of an auxiliary lock, comprising: a drawing plate having a top portion extended toward one side, thereby forming a top flat portion, a first end of said drawing plate and said top flat portion capable of being locked into a slot of a lock tongue, said drawing plate having a positioning hole aligning with a positioning hole of said lock tongue, a positioning member extended through said positioning hole of said drawing plate and said positioning hole of said lock tongue, and a top flat portion of a second end of said drawing plate.

2. The drawing plate structure of a latch of an auxiliary lock as claimed in claim 1, wherein said first end of said drawing plate locked into said slot of said lock tongue is provided with a bent non-flat face.

* * * * *